US010092038B2

(12) United States Patent
Xu

(10) Patent No.: US 10,092,038 B2
(45) Date of Patent: Oct. 9, 2018

(54) SINGLE USE CARTRIDGE WITH CONTACT POINT

(71) Applicant: Yongjie James Xu, Richmond, VA (US)

(72) Inventor: Yongjie James Xu, Richmond, VA (US)

( * ) Notice: Subject to any disclaimer, the term of this patent is extended or adjusted under 35 U.S.C. 154(b) by 0 days.

(21) Appl. No.: 15/274,647

(22) Filed: Sep. 23, 2016

(65) Prior Publication Data

US 2018/0084829 A1 Mar. 29, 2018

(51) Int. Cl.
*A24F 11/00* (2006.01)
*A24F 47/00* (2006.01)

(52) U.S. Cl.
CPC ..... *A24F 47/008* (2013.01)

(58) Field of Classification Search
CPC ..... A24F 47/008; A24F 11/00; A24F 25/02
USPC ..... 131/328, 329
See application file for complete search history.

(56) References Cited

U.S. PATENT DOCUMENTS 5,249,586 A * 10/1993 Morgan ..... A24F 47/008 128/200.14
7,290,549 B2 * 11/2007 Banerjee ..... A24B 15/16 131/194
8,314,591 B2 * 11/2012 Terry ..... A24F 47/008 320/114
8,528,569 B1 * 9/2013 Newton ..... A61M 15/06 128/202.21
8,910,639 B2 * 12/2014 Chang ..... A24F 47/008 131/273
9,078,473 B2 * 7/2015 Worm ..... A24F 47/008
9,259,035 B2 * 2/2016 Terry ..... A24F 47/008
9,326,547 B2 * 5/2016 Tucker ..... H01C 17/00
9,351,522 B2 * 5/2016 Safari ..... A24F 47/008
9,427,022 B2 * 8/2016 Levin ..... A24F 47/008
9,491,974 B2 * 11/2016 DePiano ..... A24F 47/008
9,532,600 B2 * 1/2017 Thorens ..... A24F 47/008
9,848,648 B2 * 12/2017 Memari ..... A24F 47/008
9,854,841 B2 * 1/2018 Ampolini ..... A24F 47/008
2014/0041655 A1 * 2/2014 Barron ..... A61M 11/042 128/202.21
2014/0096781 A1 * 4/2014 Sears ..... A24F 47/008 131/328
2015/0136158 A1 * 5/2015 Stevens ..... A24F 47/008 131/329
2015/0257447 A1 * 9/2015 Sullivan ..... A24F 47/008 131/329

* cited by examiner

*Primary Examiner* — Thanh Tam Le
(74) *Attorney, Agent, or Firm* — Nixon & Vanderhye P.C.

(57) ABSTRACT

A non-refillable microvaporizer cartridge having a casing with an external surface, an internal surface, a top end, and a bottom end, a tank defined by the internal surface, the top end, and the bottom end of the casing, a trapdoor provided at the top end of the casing having a fluid opening that provides fluid communication to the tank, and an electrical conductor provided at the bottom end of the casing. An atomizer can be attached to the top end of the casing and connected to the trapdoor, and the atomizer is operatively connected to the electrical conductor on the bottom end of the casing to complete the circuit.

12 Claims, 4 Drawing Sheets

SINGLE USE CARTRIDGE WITH CONTACT POINT

This invention relates to a single-use cartridge for a microvaporizer, in particular a single-use cartridge that has a trapdoor at the top end of the tank and an electrical contact at the bottom end of the tank.

BACKGROUND OF THE INVENTION

A microvaporizer, such as an e-cigarette, includes a mouthpiece, a heating element (also called an "atomizer "), a tank, and a battery. The e-cigarette can be in any shape and size, although it is generally cylindrical. The tank stores liquids that would be vaporized by the atomizer to create vapor for a user, also called an "e-liquid "The atomizer is typically a heating coil that is put in contact with the e-liquid to produce vapor when the e-cigarette is activated. Typically, the tank is a permanent and refillable part of the microvaporizer. The tank is attached to the atomizer and attached to the body of the vaporizer, including a battery portion on the opposite end. Some of the commercial tanks also include the heating coil inside a portion of the tank for vaporization of the e-liquid stored in the tank.

The conventional tank includes an outer casing that forms the exterior surface of the tank, and an inner casing that defines a middle air passage in the center of the tank. The e-liquid is stored in the surrounding chamber, which is located in between the outer casing and the inner casing of the tank.

The conventional tank poses several inconveniences to a user. The tank is refilled by adding e-liquid to the surrounding chamber using a dripper or squeeze bottle. It is important that the user only fills the surrounding chamber in the tank, and to avoid adding e-liquid to the middle air passage. If the e-liquid is added to the middle air passage, then the user will taste the e-liquid in the mouthpiece. The surrounding chamber is typically small in volume and difficult to refill due to its small opening between the outer casing and the inner casing of the tank. A dripper or squeeze bottle is needed to aid the user to reach the opening and refill the e-liquid into the surrounding chamber. For accuracy, the user may even have to tilt the tank to a certain angle to ensure a more accurate access to the surrounding chamber when refilling the tank.

Furthermore, if the user wants to use the e-cigarette for an extended period of time away from home, the user will need to carry a bottle of e-liquid with a dripper, or e-liquid stored inside a squeeze bottle, in addition to the e-cigarette while traveling. Moreover, it is difficult for the user to refill the tank if there is no steady light and/or surface for the user to perform the delicate task of accurately refilling e-liquid into the surrounding chamber only.

An attempt to provide a disposable cartridge has been discussed in U.S. Pat. No. 8,910,639, in which the smoking article includes a control body that houses the battery, and a disposable cartridge that is detachably connected to the control body. The cartridge includes a resistive heating element and storage of a product for vaporization. By including a resistive heating element, the cost of the disposable cartridge in the '639 patent may be high due to the complexity of the components in the cartridge during manufacturing. Furthermore, the manufacturing cost may also be high because the resistive heating element is costly. In turn, the high manufacturing cost is also reflected on the retail price of the disposable cartridges for consumers.

In addition, the conventional tank includes fluid openings at the bottom portion of the tank, which the fluid openings are usually connected to an atomizer, air flow passages, and the battery. Having fluid openings at the bottom portion of the tank increase the possibility of fluid leakage through the connecting portions between the tank and the atomizer, and the atomizer and the air flow passages. Even if the connecting portions include seals to prevent leakage, when the seals are worn from use, leakage will occur, even merely by gravitational pull.

Therefore, it is desirable to provide an improved disposable cartridge for a microvaporizer, such as an e-cigarette, that is easier to use and replace, less likely to have fluid leakage, cheaper to manufacture, and be more affordable for the consumers.

BRIEF SUMMARY OF THE INVENTION

A microvaporizer cartridge, such as used in an electronic cigarette (also known as an e-cigarette), described herein may be embodied to improve the inconveniences of the conventional fluid tank by providing a pre-filled, non-refillable cartridge that is easily removable and replaceable from the e-cigarette no matter where the user may be located. The cartridge may be a single-use consumer device which is prefilled with fluid before being sold to a consumer. The cartridge may be disposable.

The cartridge does not need to include the atomizer thus the number of components, complexity and cost of the cartridge may be minimized. The cartridge may be configured, e.g., trap door, to allow an atomizer to be in fluid communication with the fluid in the cartridge. Thus, the cartridge may be a single use device while the atomizer, which may include a resistive heating element and a heating coil, is reusable. By separating the atomizer from the tank, the manufacturing cost of the tank can be reduced, and the retail price of the tank can also be reduced for the consumers. The cartridge's fluid storage volume for vaporizable fluid may be relatively large because, in part, the volume within the cartridge is not consumed by an atomizer The cartridge may include a trapdoor, such as at the top end of the cartridge. The cartridge may also include an electrical path, e.g., wire, that directs current from a battery contact, such as at a bottom end of the cartridge, to a contact to provide current to an atomizer. The cartridge need not have an inner casing nor a middle air passage which provides greater volume for the storage of fluid.

Having a trapdoor that is displaced, e.g., opened, by an atomizer on the top end of the cartridge reduces possibilities of fluid leakage from the bottom of the cartridge. The trap door when closed prevents fluid leaking from the cartridge. When the trap door is opened, fluid may flow from the cartridge. By configuring the trap door such that it is opened by the atomizer as the cartridge is inserted in the e-cigarette, the trap door functions to prevent leakage except while the cartridge is positioned on, over or adjacent the atomizer when fluid flow from the cartridge is desired. The trapdoor may be resealable such that the disposable cartridge can be taken out before the fluid in the tank is depleted, and the user can replace the existing tank with another tank for a different flavoring or to store the cartridge after a period of use of the cartridge.

An exemplary embodiment of a non-refillable microvaporizer cartridge, such as an e-cigarette cartridge, includes a casing that has an external surface and an internal surface, and a top end and a bottom end, a tank defined by the internal surface, the top end, and the bottom end of the casing, a trapdoor provided at the top end of the casing that has a fluid opening to provide fluid communication to the tank, and an electrical conductor provided at the bottom end of the casing. The cartridge can optionally include a disposable mouthpiece that connects directly to the atomizer and to the top end of the cartridge.

When an exemplary embodiment of a non-refillable microvaporizer cartridge is engaged in a microvaporizer, the microvaporizer includes a mouthpiece on a first end of the microvaporizer, a battery on a second end of the microvaporizer, an atomizer connected to the mouthpiece, and the non-refillable microvaporizer cartridge is provided between the atomizer and the battery.

The cartridge includes a casing having an external surface and an internal surface, a top end connected to the atomizer, and a bottom end connected to the battery, a tank defined by the internal surface, the top end, and the bottom end of the casing. A trapdoor is provided at the top end of the casing to provide fluid communication between the cartridge and the atomizer. An electrical conductor is provided at the bottom end of the casing to connect the cartridge to the battery.

In a microvaporizer, an atomizer receives fluid from an embodiment non-refillable cartridge through the trapdoor on the top end of the cartridge, and is activated by connecting to the electrical conductor on the bottom end of the cartridge. In an exemplary embodiment, an atomizer can be activated by being attached to a conductive rod that can be placed inside the cartridge. The rod can extend through the trapdoor inside the cartridge from the top end towards the bottom end to reach the electrical conductor on the opposite end of the cartridge. In another embodiment, an atomizer can be activated by being attached to a flexible conductive material that can also enter the cartridge through the trapdoor and extend inside the cartridge from the top end towards the bottom end to attach to the electrical conductor. In a further embodiment, the atomizer can be activated by being connected to a conductive material that is embedded in the casing, in between the external surface and the internal surface of the casing.

The above described embodiments provide a cost effective and user-friendly improvement to the conventional microvaporizer. The disposable cartridge eliminates the need to refill the tank by a user, and improves fluid leakage issues from the microvaporizer.

DETAILED DESCRIPTION OF THE INVENTION

Figure 1:
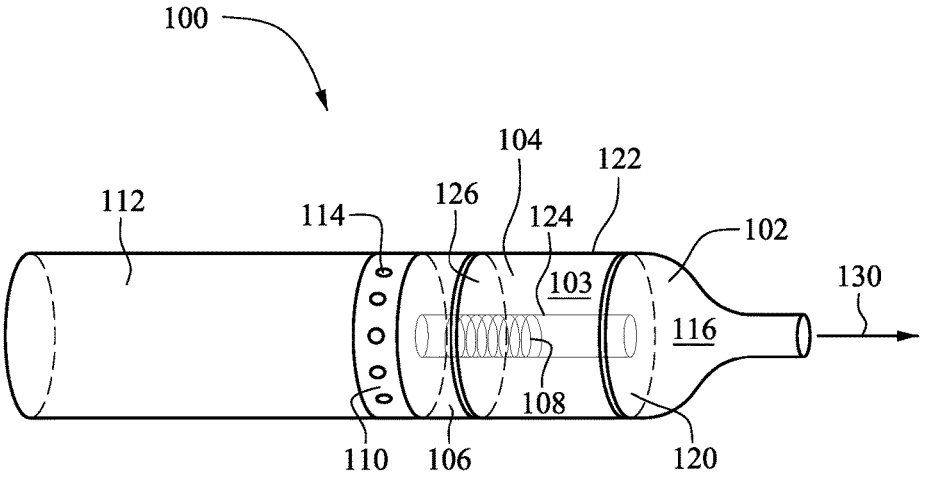
FIG. 1 is a schematic drawing of a conventional electronic cigarette.

A conventional personal microvaporizer, such as an electronic cigarette, is shown in FIG. 1. An electronic cigarette 100 typically has a mouthpiece 102, a cartridge 104, a base 106, an atomizer 108, an airflow controller 110, and a battery 112. The airflow controller 110 includes air inlets 114 that draws air into electronic cigarette 100. The cartridge includes a fluid tank 103 that is defined in between an outer casing 122, an inner casing 124, a top end of the casing 120, and a bottom end of the casing 126. The cartridge 100 is coupled to a mouthpiece 102 on the top end of the casing 120, and coupled to an atomizer 106 on the bottom end of the casing 126. The atomizer 106 is also coupled to an airflow controller 110, and a battery 112.

The atomizer 106 is capable of drawing fluid from the tank 103 towards a heating element 108 in the atomizer 106, typically through a fluid opening 128 provided on the inner casing 124 that is aligned with a fluid intake in the atomizer. The atomizer 106 produces vapor when it is connected to and powered by the battery 112, by drawing air from at least one air inlet 114 in an airflow controller 110 of the electronic cigarette 100 towards the heating element 108, which vaporizes fluid drawn from tank 103. The resulting vapor escapes from the heating element 108 through the inner casing 124 into the vapor chamber 116, then the vapor is consumed by a user through a mouthpiece 130. The e-cigarette 100 can be activated via different methods that electrically connects the battery 112 to the atomizer 106, and produces vapor by heating the fluid.

When the fluid is depleted from a conventional tank 103, a user has to remove the mouthpiece 102 to access the top end of the casing 120 to refill the tank 103 with additional fluid. The tank 103 is typically accessed via an opening that is in between the outer casing 122 and inner casing 124, which may be small such that a user has to use a dripper or a squeeze bottle to fill the fluid into the tank 103. If fluid is accidently filled into the radially inner portion of the inner casing 124, fluid is likely to leak through the atomizer and airflow controller, and the user may get a bad taste in the vapors from the excess fluid in the atomizer. In addition, a user has to keep bottles of fluid with a dripper, or squeeze bottles of fluid, in a stationary location or carry the bottles for refilling the electronic cigarette while traveling. Thus, the refill process is very detail intensive and inconvenient for a user.

Furthermore, a conventional electronic cigarette, such as shown in FIG. 1, typically develop leaking issues between seals of the fluid opening 128 and the atomizer 106 due to normal wear and tear of the electronic cigarette usage. The leakage results in a loss of the fluid from the tank into the atomizer and out of the apparatus through the air inlets in the airflow controller that is coupled to the atomizer. The leakage may also result in the electronic cigarette producing more vapor than desired by the user during one puff of the electronic cigarette, thus depleting the fluid in a faster pace than it would have been otherwise. Leakage will not only happen during use of the electronic cigarette, but also during the non-use period due to gravitational pull on the fluid in the tank. In a conventional electronic cigarette, leakage is difficult to prevent.

The present invention provides a single-use disposable cartridge for a microvaporizer, such as an e-cigarette, which is easy to use and replaceable. The single-use cartridge allows the user to replace only the tank portion using a prefilled cartridge. The user would not need to manually refill the e-cigarette with bottled liquid using droppers or squeeze bottles. Instead, a user can simply remove the entire cartridge from the vaporizer, keeping the atomizer intact in the microvaporizer, and substitute another prefilled cartridge in place of the previous cartridge.

To reduce cost, the disposable cartridge does not include an atomizer, and can be retrofitted to fit any types of atomizer and vaporizer body from the different brands of vaporizers. The cartridge includes a seal or trapdoor that is used to seal the liquid openings in the cartridge. The seal or trapdoor can be resealable, such that the cartridge may be changed out with another cartridge, such as for different flavoring, and the resealable seal or trapdoor would prevent leakage of the fluid content in the cartridge. Alternatively, the seal or trapdoor can be for single-use only, and non-resealable. The single-use disposable cartridge, with or without a resealable trapdoor, is discarded after the fluid is depleted from the tank.

Figure 2:
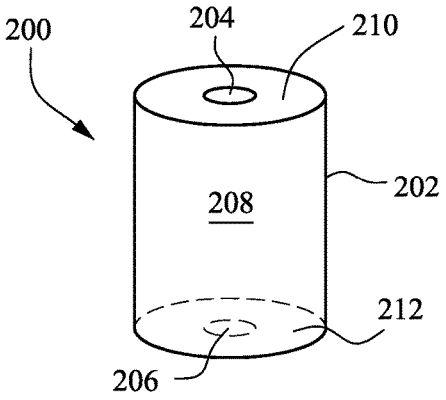
FIG. 2 is a schematic simplified drawing of an embodiment cartridge having a trapdoor that acts as the fluid opening at the top of the tank, and an electrical conductor at the bottom of the cartridge.

An improved disposable cartridge embodiments is depicted in FIG. 2, which shows a general embodiment of a single-use disposable cartridge 200 having a casing 202, a fluid opening 204 on the top end of the casing 210, an electrical conductor 106 on the bottom end of the casing 212. The cartridge 200 includes a tank 208 that is defined by the casing 202, the top end of the casing 210, and the bottom end of the casing 212. The embodiments encompass improvements on the fluid leakage issue and simplify the process of refilling the electronic cigarette.

As shown, the fluid opening 204 is provided on the top end of the casing 210 to reduce the possibility of leakage due to gravitational pull on the fluid in the tank 208. The fluid opening 204 is sealed with a trapdoor, and the trapdoor can be resealable or non-resealable after the seal has been opened. The trapdoor can be non-resealable, such as being sealed by aluminum foil, wax paper, a disposable plug, and the like. The trapdoor can be resealable, such as having a screw seal, butterfly seal, twist seal, spring-loaded seal, compressible plug, and the like. The fluid opening 204 and trapdoor are connected to an atomizer on the top end of the casing 210, such that the fluid is drawn into the atomizer from the top end 210 for vaporization.

Figure 3:
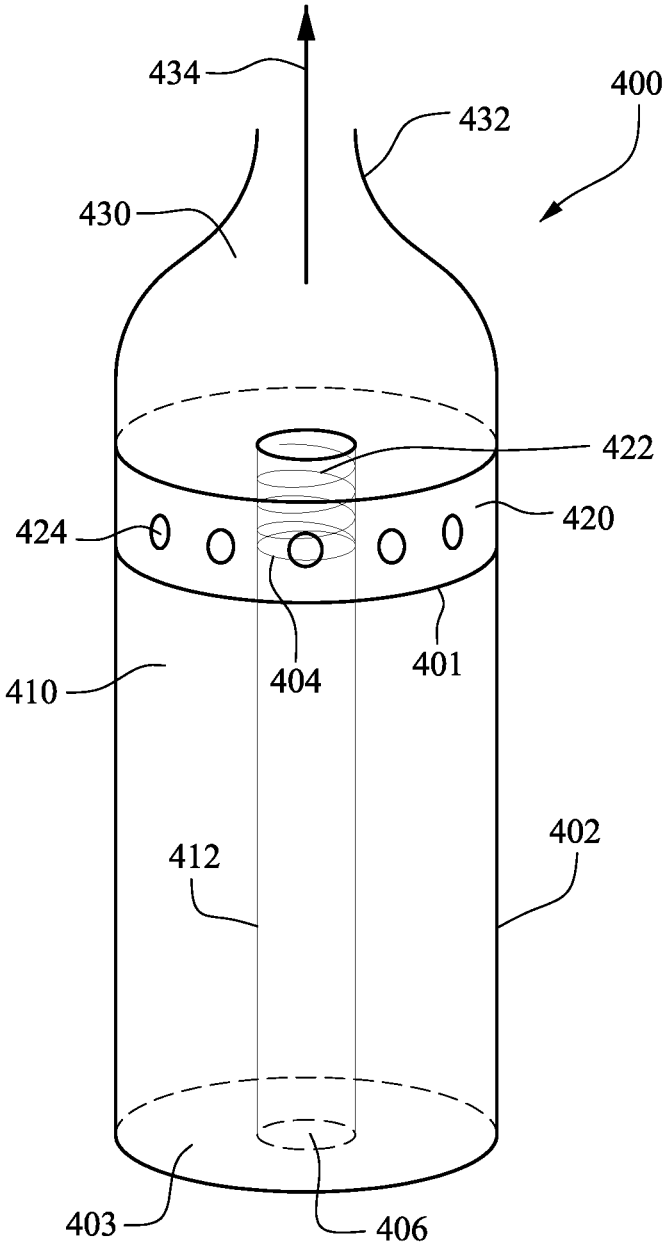
FIG. 3 is a schematic drawing of another embodiment cartridge that includes conductive material being embedded in the casing.
Figure 4:
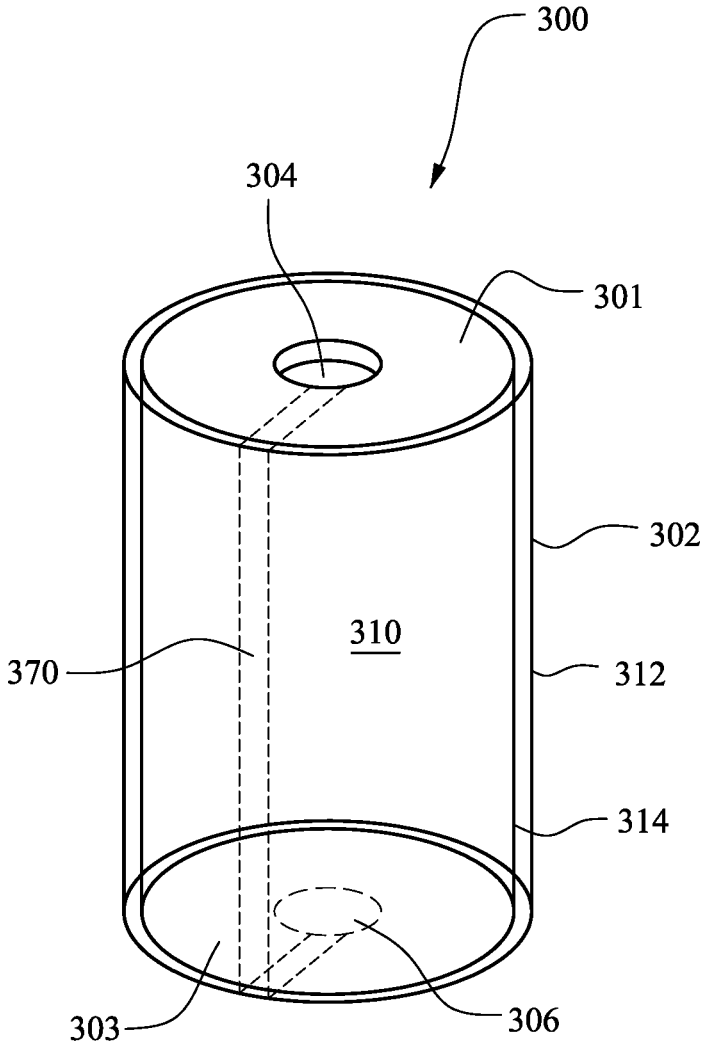
FIG. 4 is a schematic drawing of an additional embodiment cartridge attached to an atomizer with air inlets and a mouthpiece, the cartridge includes a conductive rod provided inside the tank to connect between the atomizer on the top end of the cartridge to the electrical conductor on the bottom end of the cartridge.
Figure 5:
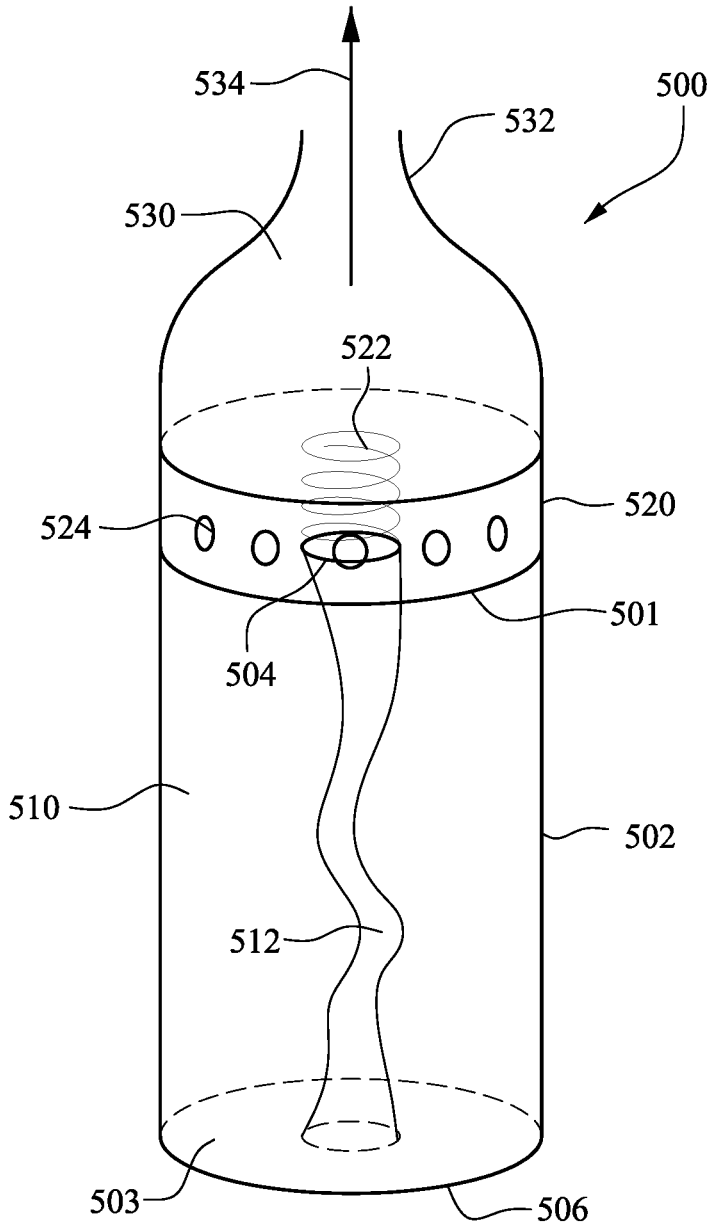
FIG. 5 is a schematic drawing of a further embodiment cartridge attached to an atomizer with air inlets and a mouthpiece, the cartridge includes a flexible conductive material provided inside the tank to connect between the atomizer on the top end of the cartridge to the electrical conductor on the bottom end of the cartridge.

The electrical conductor 206 on the bottom end of the casing 202 is connected to a battery on the bottom end of the casing 212. The electrical conductor 206 is not drawn to scale. The electrical conductor 206 can cover between a portion of the area the bottom end of the casing 212 to a full area of the bottom end of the casing 212. The atomizer, coupled to the top end of the casing 210, is activated when it is connected to the electrical conductor 206 on the bottom end of the casing 212. Different ways to connect electrically between the atomizer and the electrical conductor are illustrated in FIGS. 3, 4, and 5.

In a separate embodiment, a cartridge 300 can have a casing 302 having an external surface 312 and an internal surface 314 that defines the tank 310 with a top surface 301 and a bottom surface 303. The cartridge 300 has a fluid opening 304 sealed by a trapdoor and coupled to an atomizer. The atomizer is connected to the electrical conductor 306 via a conductive material 320 that is embedded in the casing 302 between the external surface 312 and the internal surface 314. The conductive material 320 can be embedded in at least one partial portion of the casing 302 or in the entire casing 302, so long as the conductive material connects between the fluid opening 304 and the electrical conductor 306.

The cartridge 300 may additionally be provided with the atomizer, may be provided with a mouthpiece on the top end of the casing, or may be provided with both the atomizer and mouthpiece at the top end of the casing as a single disposable unit.

In another embodiment, a cartridge 400 can have a casing 402, a top end of the casing 401, and a bottom end of the casing 403 that defines a tank 410. The top end of the casing 401 includes a fluid opening 404 that is sealed by a trapdoor. The fluid opening 404 with the trapdoor can be coupled to an atomizer 422 and an airflow controller 420 having air inlets 424. A mouthpiece 432 is also coupled to the atomizer 422 and air controller 420.

In this embodiment, the atomizer is connected to the electrical conductor 406 by being coupled to a conductive rod 412 that extends from the atomizer 422, through the trapdoor and fluid opening 404, and extends directly from the top end of the casing 401 through the tank 410 to connect to the electrical conductor 406 at the bottom end of the casing 403. As the atomizer 422 is activated by a supply of electrical current from the battery via the electrical conductor 406, the atomizer 422 draws fluid from the tank 410 and produces vapor 434 that exits into the vapor chamber 430, and is supplied to the user through the mouthpiece 432.

By inserting the conductive rod 412 into the tank 410 to connect electrically between the atomizer 422 and the electrical conductor 406, the atomizer 422 and the electrical conductor 406 is directly connected, and the cartridge 400 is still able to hold a substantially maximum amount of fluid in the tank 410. The cartridge 400 may be provided alone without the atomizer and mouthpiece, provided with the atomizer, provided with the mouthpiece, or provided with both the atomizer and mouthpiece as a single disposable unit.

Another embodiment cartridge 500 is shown in FIG. 5 with a flexible conductive material 512 that is inserted inside the tank 510 as the connecting method used to connect electrically between the atomizer 522, through fluid opening 504 and trapdoor at the top end of the casing 501, and the electrical conductor 506 at the bottom end of the casing 503. The tank 510 is defined by a casing 502, the top end of the casing 501, and the bottom end of the casing 503. The fluid opening 504 is coupled to a trapdoor that can be resealable or non-resealable, and is coupled to the atomizer 522 for vaporization of the fluid stored in the tank 510. The cartridge 500 can also be coupled to an airflow controller 520 having air inlets 524 to supply air to the atomizer 522 for drawing fluid from the tank 510 and producing vapor 524. Vapor 534 is produced by the atomizer 522, and moves upwards in the vapor chamber towards the mouthpiece 532 towards the user. The fluid is unlikely to leak from the cartridge 500 due to gravitational pull, and because the conducting material is a flexible material, such as a conducting wire, conducting cloth, and the like, the tank 510 can have a maximum volume to store fluid for vaporization.

In all of the embodiments described, the conducting material can also act as a fluid facilitator, such as a wick, to draw fluid to the atomizer for vaporization. Alternatively, a separate fluid facilitator can be added to the embodiments to draw fluid from the tank towards the atomizer. The possibility of fluid leakage due to gravitational pull and worn-out seals is reduced by providing the fluid opening on the top end of the casing. In the embodiments, the fluid opening is sealed with a trapdoor, and the trapdoor can be resealable or non-resealable. The trapdoor can be non-resealable, such as being sealed by aluminum foil, wax paper, a disposable plug, and the like. The trapdoor can be resealable, such as having a screw seal, butterfly seal, twist seal, spring-loaded seal, compressible plug, and the like. The fluid opening and trapdoor are connected to an atomizer on the top end of the casing, such that the fluid is drawn into the atomizer from the top end for vaporization.

The electrical conductor on the bottom end of the casing is connected to a battery on the bottom end of the casing. The electrical conductor can cover between a portion of the area the bottom end of the casing to a full area of the bottom end of the casing. The atomizer, coupled to the top end of the casing, is activated when it is connected to the electrical conductor on the bottom end of the casing.

The single-use disposable cartridges described herein provide simplified and cost effective versions of a disposable cartridge for a microvaporizer. Using some additional support and/or connecting portions if needed, the atomizer can be immersed directly into the fluids stored in the tank. The embodiment provide direct access to fluids for the atomizer, which reduces potential overheating of the atomizer, inconsistent fluid supply to the atomizer, and simplifies the procedure to replace a disposable cartridge in a microvaporizer. The embodiment also provide direct access from the atomizer to the battery via the electrical conductor while maximizing the volume of the tank in the cartridge.

In addition, because the trapdoor acts as a seal and a liquid opening, and the liquid opening is provided on the top of the microvaporizer, the embodiments reduce fluid leakage due to gravity and/or worn seals that no longer provide a snug seal. It also reduces the cost of manufacturing the disposable cartridges because there are less number of parts to manufacture, and the shape of the cartridge is simplified. The tank of the cartridge can have a maximum volume to hold the fluids for vaporization to reduce the number of replacements needed.

The cartridges described may also be adjusted to fit different brands and types of microvaporizers by changing the diameter of the cartridge and the length of the cartridge along the axis. To ensure a good fit between the cartridges and the different types of microvaporizers, silicon seals, movable seals, and other connectors may be manufactured or retrofitted from the microvaporizers as described.

All of the described exemplary cartridges allow the user to replace the cartridge in a microvaporizer quickly and accurately. The cartridges can be made, or retrofitted with supporting parts, to accommodate and connect to the different brands and types of microvaporizers. In addition, the exemplary cartridges are cheaper and simpler to manufacture because the cartridge does not include the atomizer, which typically is reusable and outlast the liquids in the cartridge.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A non-refillable microvaporizer cartridge, comprising:

a casing having a sidewall, a first end, a second end opposite to the first end, and the sidewall between the first end and the second end;

a tank defined, at least in part, by the internal surfaces of the sidewall, the first end, and the second end of the casing;

a trapdoor provided at the first end of the casing, having a fluid opening configured to provide fluid communication to the tank at the first end of the casing;

a first electrical conductor provided at the second end of the casing configured to engage with a power source;

a second electrical conductor provided at the first end configured to engage an atomizer, and a conductive material extending from the first electrical conductor to the second electrical conductors, wherein the conductive material is attached to and extends along the sidewall from the second end to the first end.

2. The non-refillable microvaporizer cartridge of claim 1, wherein the trapdoor is resealable by a suitable mechanism.

3. The non-refillable microvaporizer cartridge of claim 1, wherein the trapdoor is non-resealable.

4. The non-refillable microvaporizer cartridge of claim 1, wherein the electrical conductor is configured to be electrically connected with a heating element in the atomizer.

5. The non-refillable microvaporizer cartridge of claim 4, wherein the conductive material includes a flexible conductive material.

6. The non-refillable microvaporizer cartridge of claim 1, wherein the power source includes a battery.

7. The non-refillable microvaporizer cartridge of claim 1 further comprising a mouthpiece configured to connect directly to the atomizer on the first end of the casing.

8. A non-refillable microvaporizer cartridge comprising:

a casing having a sidewall, a first end and a second end opposite to the first end, wherein the sidewall extends between the first and second ends;

a tank defined, at least in part, by internal surfaces of the sidewall, the first end, and the second end of the casing;

a trapdoor provided at the first end of the casing, having a fluid opening configured to provide fluid communication to the tank at the first end of the casing; and an electrical conductor provided at the second end of the casing, wherein the electrical conductor is configured to be connected with an atomizer that is attached to the first end of the casing, and wherein the atomizer on the first end is configured to connect to the electrical conductor on the bottom end via a conductive material that is embedded in between an external surface and an internal surface of the sidewall of the casing.

9. A non-refillable microvaporizer cartridge comprising:

a casing having a first end, a second end opposite to the first end, and a sidewall extending between the first and second ends;

a tank having an outer surface defined by internal surfaces of the first end, second end and sidewall of the casing;

a trapdoor to the tank and provided at the second end of the casing, the trapdoor having a fluid opening configured to establish a fluid passage from the tank and through the second end of the casing;

first electrical conductor at the first end of the casing and configured to engage with a power source;

a second electrical conductor at the second end of the casing and configured to engage a heating element for a micro-vaporizer, and a conductive material attached to and extending along the sidewall from the first end to the second end of the casing, wherein the electrical conductor forms a conductive path from the first electrical conductor to the second electrical conductor.

10. The non-refillable micro-vaporizer cartridge of claim 9 wherein the sidewall of the casing is cylindrical.

11. The non-refillable micro-vaporizer cartridge of claim 9 wherein the casing further comprises a center air passage.

12. The non-refillable micro-vaporizer cartridge of claim 9 wherein the conductive material is embedding in the sidewall.

* * * * *